United States Patent [19]

Di Perna

[11] 3,957,009

[45] May 18, 1976

[54] SHIP BALLAST, OIL AND WATER SEPARATION SYSTEM

[76] Inventor: James Di Perna, 85 Foxhill Terrace, Staten Island, N.Y. 10305

[22] Filed: Oct. 25, 1974

[21] Appl. No.: 517,897

[52] U.S. Cl. ..... 114/74 R; 114/.5 T

[51] Int. Cl.[2] ..... B63B 25/08

[58] Field of Search..... 114/.5 R, .5 F, .5 T, 114/74 R, 74 A, 74 T, 121, 125; 210/242, DIG. 21

[56] References Cited

UNITED STATES PATENTS

| | | | |
|---|---|---|---|
| 2,876,903 | 3/1959 | Lee | 114/.5 T |
| 3,399,645 | 9/1968 | Dahan | 114/74 R |
| 3,722,690 | 3/1973 | Stenström | 210/DIG. 21 |
| 3,727,765 | 4/1973 | Henning, Jr. et al. | 210/DIG. 21 |
| 3,745,115 | 7/1973 | Olsen | 210/DIG. 21 |
| 3,844,239 | 10/1974 | McLaughlin et al. | 114/74 R |

FOREIGN PATENTS OR APPLICATIONS

| | | | |
|---|---|---|---|
| 125,736 | 11/1960 | U.S.S.R. | 210/242 |

*Primary Examiner*—Trygve M. Blix
*Assistant Examiner*—Jesus D. Sotelo
*Attorney, Agent, or Firm*—Richard L. Miller

[57] ABSTRACT

A system installed within a tanker vessel for collecting all residue oil within a single tank of the vessel so that ballast water within other tanks can be readily discharged into the sea, without oil pollution thereof, prior to refilling with oil; the system consisting of a floating oil collector in ach tank that collects all oil above a water surface therewithin, the collected oil being transported through a pipe to the single collection tank; and the vessel already incorporating systems for pumping sea water into the tanks to serve as ballast, and for pumping the ballast water back into the sea thereafter.

5 Claims, 5 Drawing Figures

11
10
13
12
14
36
30
32
17
18
12a
22
21
25
26

4
4
10
10a
12
15
16
17
18
20
23
24
25
30
36
39

SHIP BALLAST, OIL AND WATER SEPARATION SYSTEM

This invention relates generally to oil tanker vessels.

It is well know to those skilled in the oil tanker industry, that after the oil tanker unloads an oil cargo at a delivery port, it must then pump sea water into its emptied oil tanks so to serve as ballast for the ship on its return voyage. Upon nearing its oil receiving port, the water is discharged back into the sea so the tanks are empty to receive another cargo of oil. Such practice is now regarding as objectionable because the water pumped back into the sea is mixed with residue oil that could not be pumped out at the delivery port, and which when now dumped into the sea, contaminates the ocean water. On a vast scale, such practice amounts possibly up to hundreds of tons of oil polluting the sea each year. This situation is, of course, seriously objectionable, and is therefore, in want of an improvement.

Accordingly, it is a principle object of the present invention to provide a system for an oil tanker that prevents discharging residue oil into the sea when the water ballast is pumped from the ship tanks back into the sea.

Another object is to provide a system in which the residue oil left in each tank after an oil delivery is thereafter removed from the tanks and is collected in a collection tank, so the sea water pumped into the tanks does not become contaminated, and so it is safe thereafter to return to the sea without polluting the same.

Still another object is to provide a system which in case of a tank rupture, the oil in the tank can be transfered to other tanks instead of leaking overboard, resulting in ocean pollution and loss of revenue by lost oil and without capsizing the ship.

Still another object is to provide a system that is readily adaptable for use in oil refineries, industrial plants, small boats, bilge drain systems and in oil well drilling systems.

Other objects are to provide a ship ballast, oil and water separation system which is simple in design, inexpensive to manufacture, rugged in construction, easy to use and efficient in operation.

These and other objects will become readily evident upon a study of the following specification and the accompanying drawing wherein.

Figure 1:
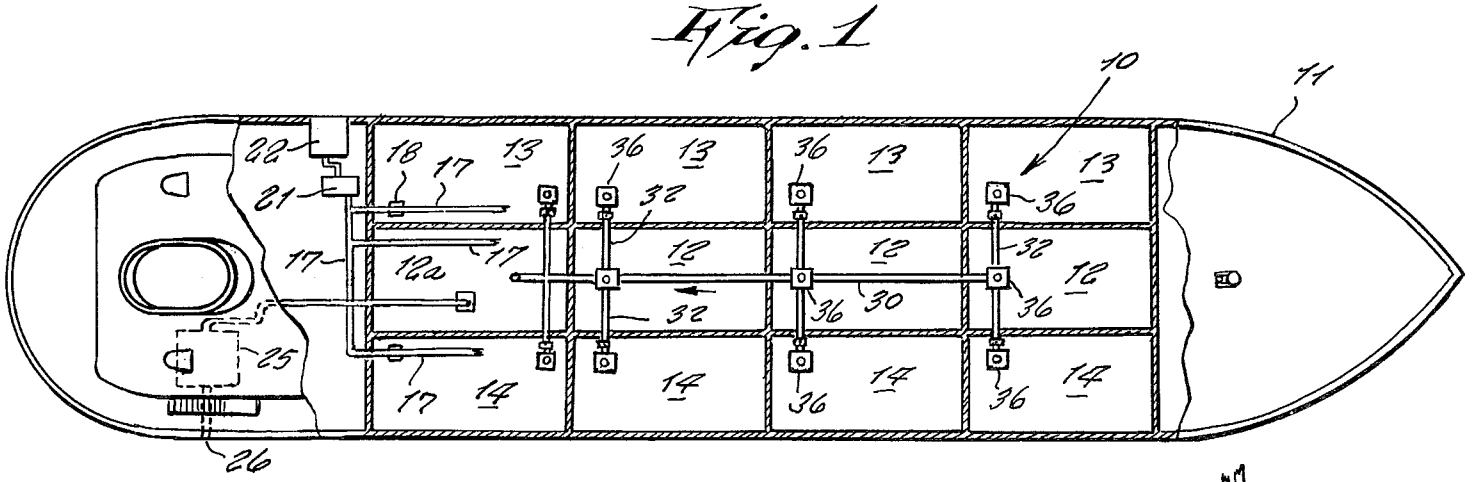
FIG. 1 is a top view of a ship, partly broken away so to show the invention.
Figure 2:
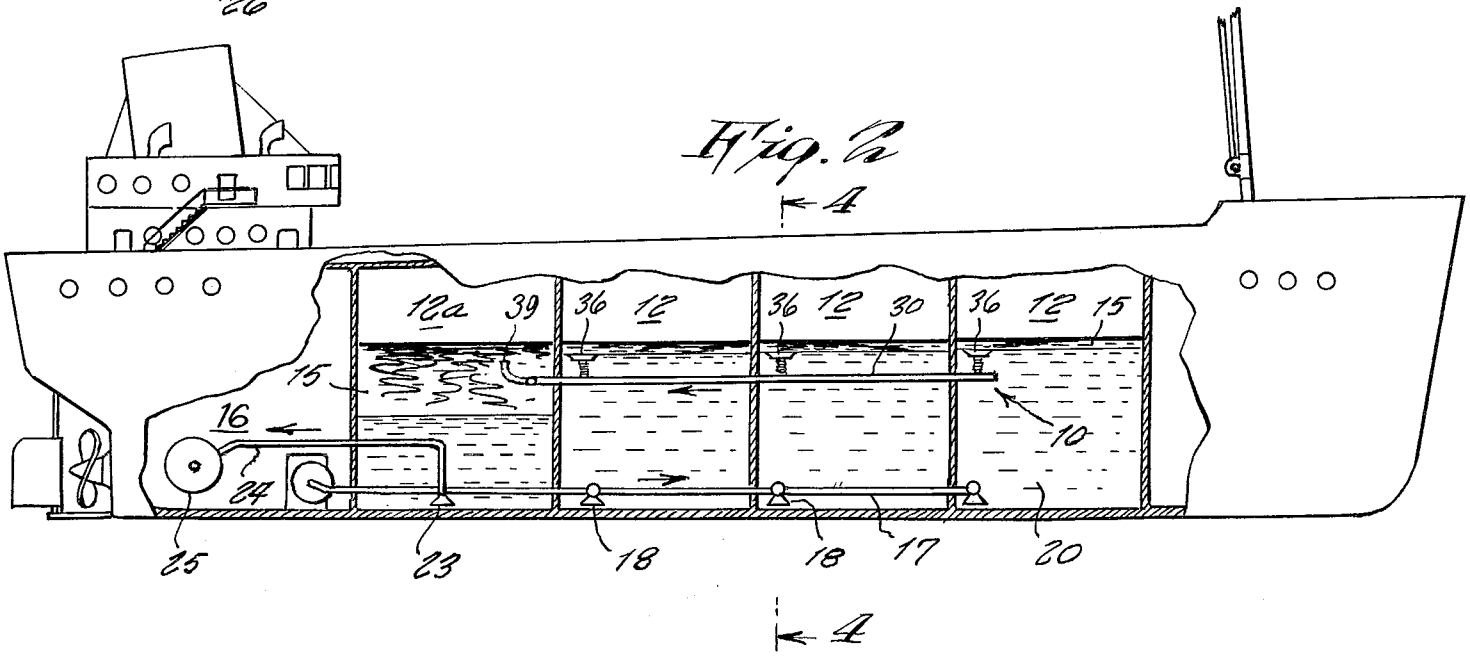
FIG. 2 is a side view thereof partly in cross section.
Figure 3:
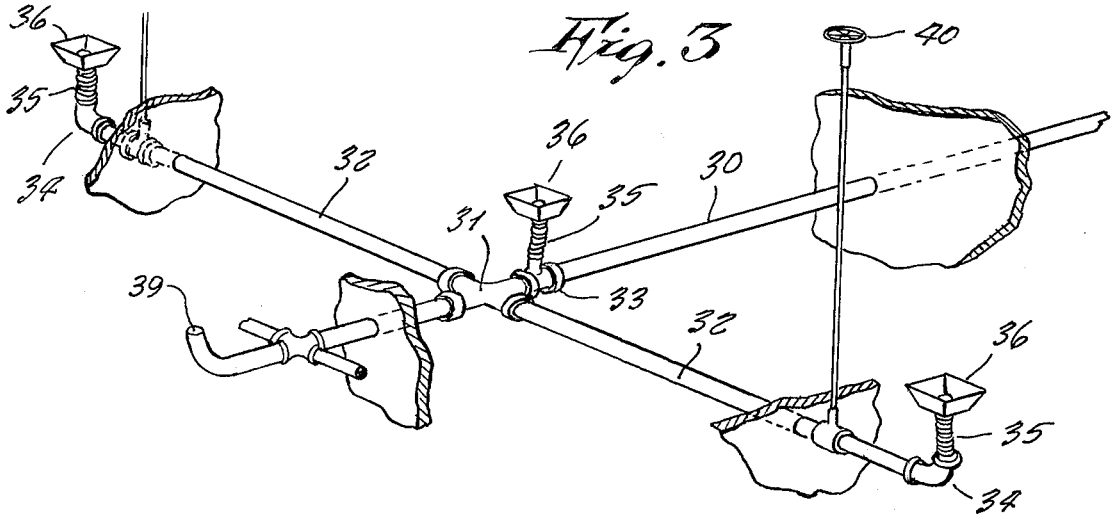
FIG. 3 is a detail of the invention piping.
Figure 4:
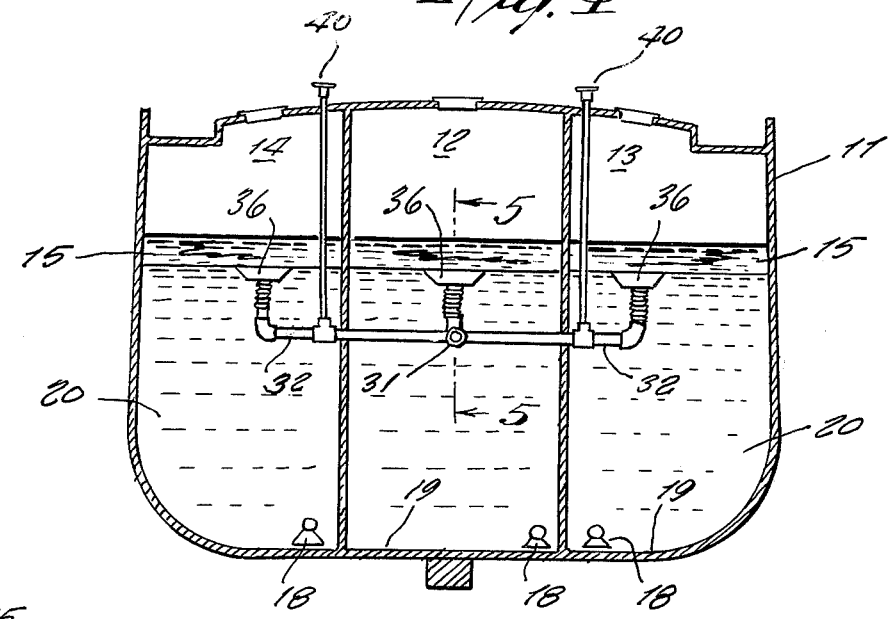
FIG. 4 is a cross section on line 4—4 of FIG. 2.
Figure 5:
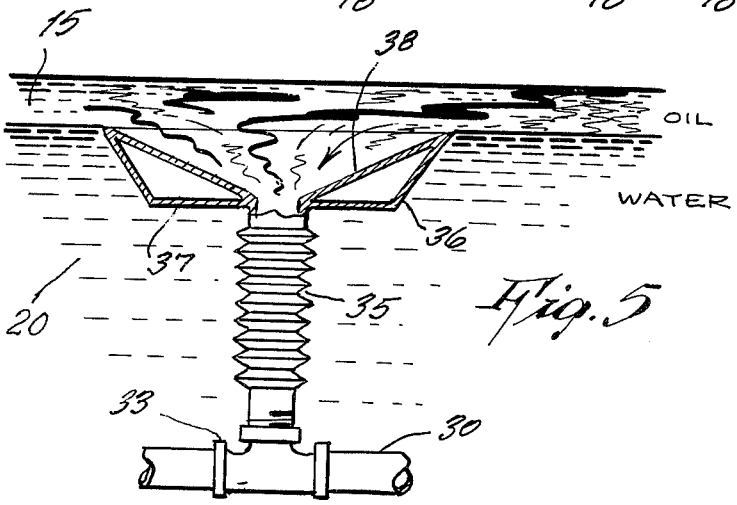
FIG. 5 is a cross sectional view on line 5—5 of FIG. 4.

Referring now to the drawing in detail, the reference numeral 10 represents a ship ballast, water and oil separation system according to the present invention which is installed within an oil tanker vessel 11 having a series of transverse rows of tanks including amid-ship tanks 12, starboard wing tanks 13 and port wing tanks 14, all of which are for carrying oil 15.

The vessel already includes an existing system 16 of pipes 17 running along the bottom of the tanks and having downward discharge outlets 18 in each tank located near the tank bottom wall 19 for the purpose of admitting sea water 20 into the tanks and which is delivered from a pump 21 connected to a supply sea chest 22. Appropriate valves, not shown in the drawing are incorporated so to control water movement into selected ones of the tanks.

One of the end amid-ship tanks 12*a* comprises in the present invention a collection tank. A downward facing intake 23 located near the tank bottom serves to pump the ballast water out of the collection tank by being connected to outlet pipe 24 connected to pump 25 communicating with discharge port 26.

In the present invention, the oil and ship ballast water separation system 10 includes a main pipe 30 extending longitudinally through the amid-ship tanks 12 and which is connected by cross-tees 31 to a series of branch pipes 32 extending sideways therefrom and leading into the wing tanks 13 and 14.

In each one of the tanks 12, except in the collection tank 12*a*, a tee 33 along the main line, and in each one of the tanks 13 and 14, an elbow 34 on the branch pipe end are connected to an upward extending flexible, accordion pipe or duct 35 which at its upper end is connected to a floating oil collection unit 36 which includes a buoyant collar 37 around a downwardly converging funnel 38 that is open on top. The buoyancy of the collar is such that the floation of the unit is with the upper edge of the funnel being at water level surface, so that only oil above the water level flows down into the funnel. The main pipe 30 extends at one end into the collection tank 12*a* where it is fitted with an upwardly turned elbow 39, so that the oil from all the tanks is thus collected in the collection tank. Valves 40 manually controlled from the deck selectively operate the unit 36.

In operative use, it is now evident that prior to returning ballast water back into the sea, the residue oil is thus removed from the tanks on a day when the ship is not excessively rolling or pitching so that the oil is steady on top thereof. After the oil is removed, the ballast water is returned to the sea prior to entry into port without contaminating the sea.

The collected oil in the collection tank can be either pumped out afterwards for purification or can be delivered at an oil receiving port on a next voyage.

A further feature of the present invention is that the oil and water mixture which is transferred to the collection tank need never flow thru any pumps since difference between liquid levels in the tanks cause the liquid to transfer due to gravity. This is an important improvement over existing systems which pump oil and water mixtures into a slop tank or to on shore processing stations, because the pump emulsifies the mixture making separation much more difficult or almost impossible.

While various changes may be made in the detail construction, it is understood that such changes will be within the spirit and scope of the present invention as is defined by the appended claims.

What is claimed is:

1. In a ship ballast, oil and water separation system for use on oil tanker vessels, the combination of a plurality of oil tanks in said vessel, a pipe assembly connecting to each of said oil tanks and positioned to lie within the upper part of said oil tanks at slightly below water surface level when said tanks are filled with water, a collection tank connected to the output of said pipe assembly for removal of residue floating oil from said oil tanks into said collection tank, and a floating oil collection unit located in each of said oil tanks coupled to the pipe assembly positioned within that tank, said floating oil collection unit including a funnel whose top is maintained at the water surface level, below the floating oil, when said tanks contain water with a layer of oil thereon.

2. The combination as set forth in claim 1 wherein said pipe assembly includes a main pipe and branch pipes, said main pipe extending through amid-ship tanks of said vessel and said branch pipe extending into wing tanks of said vessel.

3. The combination as set forth in claim 2 wherein an upward extending flexible accordion pipe is located in each said tank and is connected to said pipe assembly at its lower end, an upper end of said accordion pipe being connected to the floating oil collection unit.

4. The combination as set forth in claim 3 wherein said oil collecting unit comprises a floatation collar around a downwardly converging funnel that is open on top.

5. The combination as set forth in claim 4 wherein said collar contains a quantity of buoyant material so an upper edge of said funnel is at a water level when floating in water.

* * * * *